US012435619B2

(12) United States Patent
Tareeva et al.

(10) Patent No.: US 12,435,619 B2
(45) Date of Patent: Oct. 7, 2025

(54) SYSTEM FOR MONITORING THE PROFILE OF THE BOTTOM OF THE BOREHOLE AT THE REAMING STAGES DURING THE CONSTRUCTION OF COMMUNICATIONS USING THE HORIZONTAL DIRECTIONAL DRILLING METHOD

(71) Applicant: Elena Alekseevna Tareeva, Ulyanovsk (RU)

(72) Inventors: Elena Alekseevna Tareeva, Ulyanovsk (RU); Dmitry Alexandrovich Gurman, Kransy Yar (RU); Aleksey Anatolevich Lankov, Ulyanovsk (RU); Aleksandr Vladimirovich Lyakhov, Ulyanovsk (RU)

( * ) Notice: Subject to any disclaimer, the term of this patent is extended or adjusted under 35 U.S.C. 154(b) by 0 days.

(21) Appl. No.: 18/029,519

(22) PCT Filed: Jun. 2, 2022

(86) PCT No.: PCT/RU2022/000185

§ 371 (c)(1),
(2) Date: Mar. 30, 2023

(87) PCT Pub. No.: WO2022/220706

PCT Pub. Date: Oct. 20, 2022

(65) Prior Publication Data

US 2024/0011390 A1 Jan. 11, 2024

(51) Int. Cl.
*E21B 7/28* (2006.01)
*E21B 7/04* (2006.01)
(Continued)

(52) U.S. Cl.
CPC ..... *E21B 47/022* (2013.01); *E21B 7/046* (2013.01); *E21B 47/12* (2013.01); *E21B 2200/22* (2020.05)

(58) Field of Classification Search
CPC ..... E21B 7/046; E21B 7/28
See application file for complete search history.

(56) References Cited

U.S. PATENT DOCUMENTS 4,361,192 A 11/1982 Trowsdale
5,337,002 A 8/1994 Mercer
(Continued)

FOREIGN PATENT DOCUMENTS

CA 2300550 C 9/2004
CA 2976655 A1 2/2018

OTHER PUBLICATIONS

International Search Report for PCT/RU2002/000185 mailed on Oct. 20, 2002.

*Primary Examiner* — Kenneth L Thompson
(74) *Attorney, Agent, or Firm* — Patentbar International PC

(57) ABSTRACT

The invention relates to systems for monitoring the angles of the bottom of the borehole for horizontal directional drilling (HDD), used when performing works on trenchless laying of engineering communications. A system for monitoring the profile of the borehole bottom at the stages of reaming during the construction of communications using the method of horizontal directional drilling, which contains a computer, software installed on it for processing and constructing a profile of the bottom of the borehole, is made with the ability to connect to the computer a device for monitoring the angles of the bottom of the borehole. At the same time, the device for monitoring the angles of the bottom of the borehole consists of a housing with accelerometers installed in it, an electronic board with a processor, a device for recording and storing information, and a power source. EFFECT: providing the possibility of determining and controlling the angles of the borehole trajectory after each reaming to correct the geometry of inserting the siphon
(Continued)

head into the borehole, providing real statistical data on the geometry of the borehole, processing them and building a profile of the borehole bottom.

2 Claims, 5 Drawing Sheets

(51) Int. Cl.
*E21B 47/022* (2012.01)
*E21B 47/12* (2012.01)

(56) References Cited

U.S. PATENT DOCUMENTS

| | | | | |
|---|---|---|---|---|
| 6,525,538 | B1 | 2/2003 | Mercer | |
| 7,195,079 | B2 * | 3/2007 | Self | E21B 7/06 175/73 |
| 8,875,810 | B2 * | 11/2014 | Meister | E21B 10/32 175/263 |
| 9,657,521 | B2 | 5/2017 | Elshafei et al. | |
| 9,879,518 | B2 * | 1/2018 | May | E21B 10/32 |
| 10,316,642 | B2 | 6/2019 | Kuckes | |
| 10,378,338 | B2 * | 8/2019 | Zeller | E21B 7/046 |
| 10,400,523 | B1 * | 9/2019 | Hunt | E21B 7/046 |
| 2002/0056201 | A1 | 5/2002 | Dallas et al. | |
| 2017/0138174 | A1 | 5/2017 | Kuckes | |
| 2017/0218747 | A1 | 8/2017 | Aklestad | |

* cited by examiner

SYSTEM FOR MONITORING THE PROFILE OF THE BOTTOM OF THE BOREHOLE AT THE REAMING STAGES DURING THE CONSTRUCTION OF COMMUNICATIONS USING THE HORIZONTAL DIRECTIONAL DRILLING METHOD

RELATED APPLICATIONS

This application is a U.S. National Stage Application of International Patent Application PCT/RU2022/000185 filed on Jun. 2, 2022 which in turn claims priority to Russian patent application RU2021110597 filed on Apr. 15, 2021, both of which are incorporated herein by reference in their entirety.

FIELD OF THE INVENTION

The invention relates to systems for monitoring the angles of the bottom of the borehole for horizontal directional drilling (HDD), used when performing works on trenchless laying of engineering communications.

BACKGROUND OF THE INVENTION

Locating systems for HDD are designed to control the movement of the drill head underground during drilling, which allows the operator of the HDD rig to drill according to the project and prevent damage to underground utilities encountered along the way. This equipment, due to its sensitivity, allows you to determine the position of the drilling head underground and accurately control it, while effectively bypassing obstacles at a considerable distance from underground objects, in particular gas pipelines, oil pipelines, water pipelines, telephone and Internet cables, collectors.

At the next stage of the construction of underground pipelines using the HDD method, namely at the reaming stage of a pilot borehole, operational control of changes in its trajectory (angles) is necessary, since during expansion of the borehole, especially multiple, any changes remain unknown. The factors influencing such a change in the borehole trajectory during reaming stage are, in particular, the heterogeneous geological structure of the soil along the drilling interval, the type of soil, the design features of the tool, and the drilling fluid. The lack of information about the change in the trajectory (angles) of the borehole can cause accidents (damage or the impossibility of bending the pipe during its laying), increase or disruption of drilling time.

Analogues have not been identified from the prior tech level.

SUMMARY OF THE INVENTION

The technical problem is the creation of a system for monitoring the borehole bottom profile at the HDD reaming stages during the construction of communications using the horizontal directional drilling method, which provides accurate information about the angles of the borehole bottom at the reaming stage, its processing and construction of the borehole bottom profile.

The technical results of the proposed solution are the ability to determine and control the angles of the borehole trajectory after each expansion on the reaming stage to correct the geometry of the insertion of the pipe siphon head into the well, to ensure that real statistical data on the geometry of the borehole are obtained, their processing and construction of the profile of the bottom of the borehole.

These technical results are achieved by the fact that the borehole bottom profile control system at the reaming stages during the construction of communications using the horizontal directional drilling method contains a computer, software installed on it for processing and building a borehole bottom profile, made with the ability to connect to the computer a device for monitoring the angles of the bottom of the borehole, while the device for monitoring the angles of the bottom of the borehole consists of a housing with accelerometers installed in it, an electronic board with a processor, a device for recording and storing information and a power source. The borehole angle control device may be connected to a computer via a cable or wireless.

Measurement and fixation of angles takes place at a static position of the drill string. After the angle control device passes through the borehole, all changes in angles relative to the static (initial) position of the drill entry point from the accelerometers enter the processor for processing and subsequent transfer to the information recording and storage device. The power supply ensures uninterrupted operation of the device, recording and storage of information. After the drill string passes through and comes to the surface, the horizontal directional drilling bottom angle control device is removed and connected to a computer for processing and building a profile of the bottom of the borehole. Knowing the lengths of the drill pipes and the angles at the corresponding intervals, as well as having the entry and exit points of the drill string to the surface as the base points, it is possible to build a profile of the bottom of the borehole with an accuracy of its angles sufficient to determine potentially dangerous places, such as underground pits and heterogeneity soil (another type of soil, quicksand). With a subsequent change in the diameter of the well when pulling the pipe siphon (welded pipes) according to the technical specifications of the customer, using the information received from the device, it is possible to change the angles of the bottom of the borehole by additional reamings for trouble-free installation of the latter. Thus, it is possible to determine and control the angles of the borehole trajectory after each reaming to correct the geometry of inserting the pipe siphon head into the well, obtain real statistical data on the geometry of the well, process them, and build the profile of the borehole bottom.

BRIEF DESCRIPTION OF THE DRAWINGS

The borehole bottom angle control device for horizontal directional drilling is illustrated by drawings, wherein.

DETAILED DESCRIPTION OF THE PREFERRED EMBODIMENTS

Figure 1:
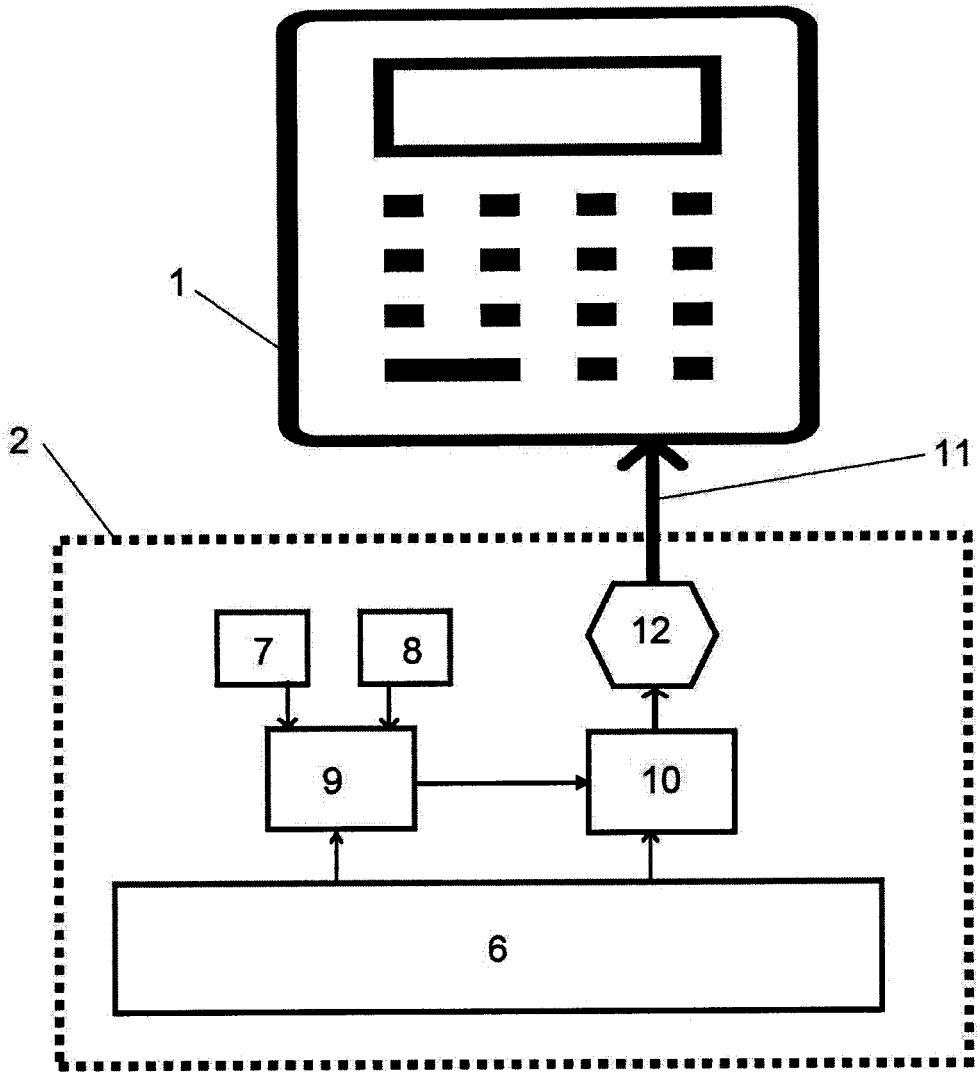
FIG. 1 shows a block diagram.
Figure 2:
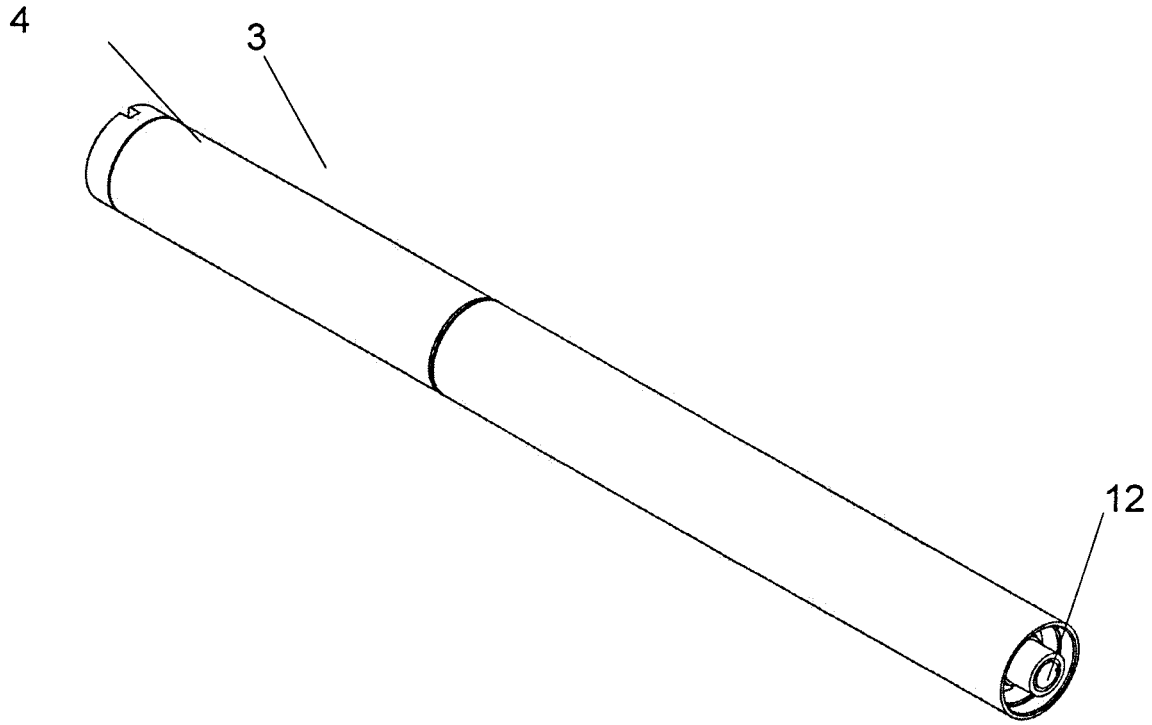
FIG. 2 shows a general view with the removed rear cover.
Figure 3:
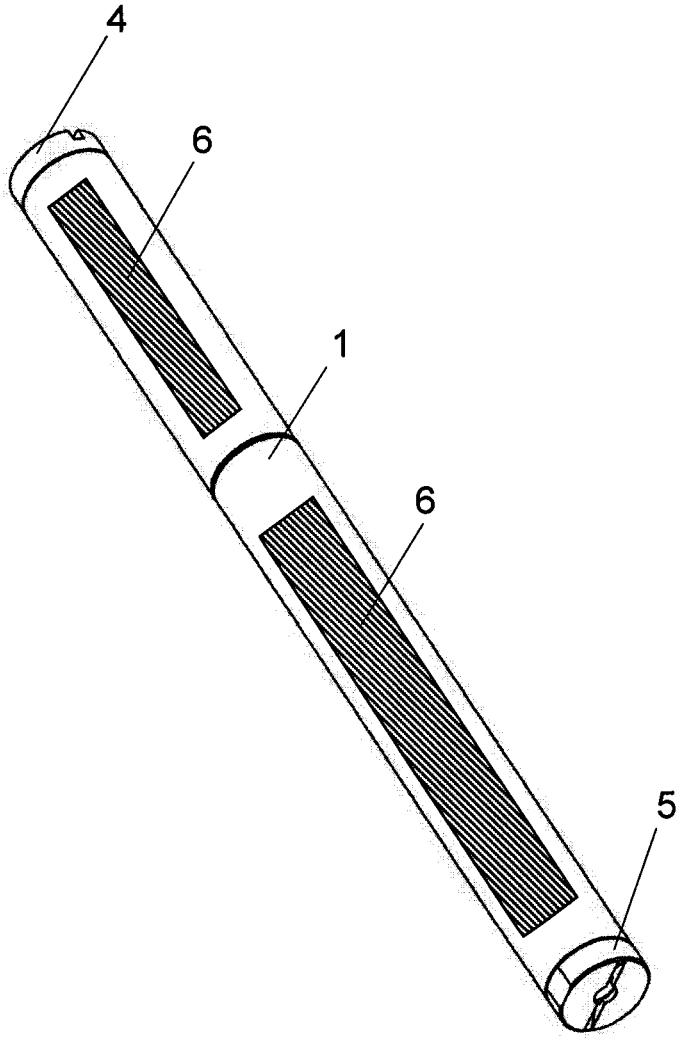
FIG. 3 shows a schematic arrangement of elements.
Figure 4:
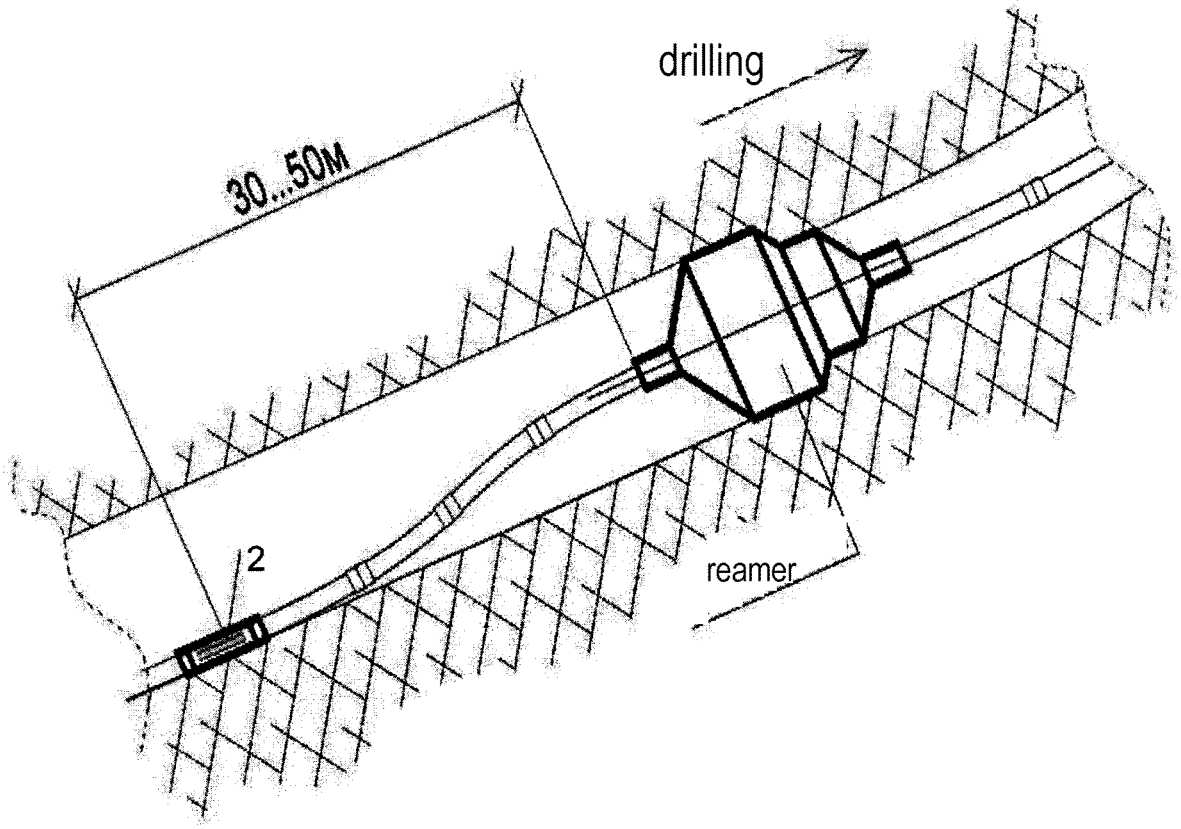
FIG. 4 shows an example of using the device.
Figure 5:
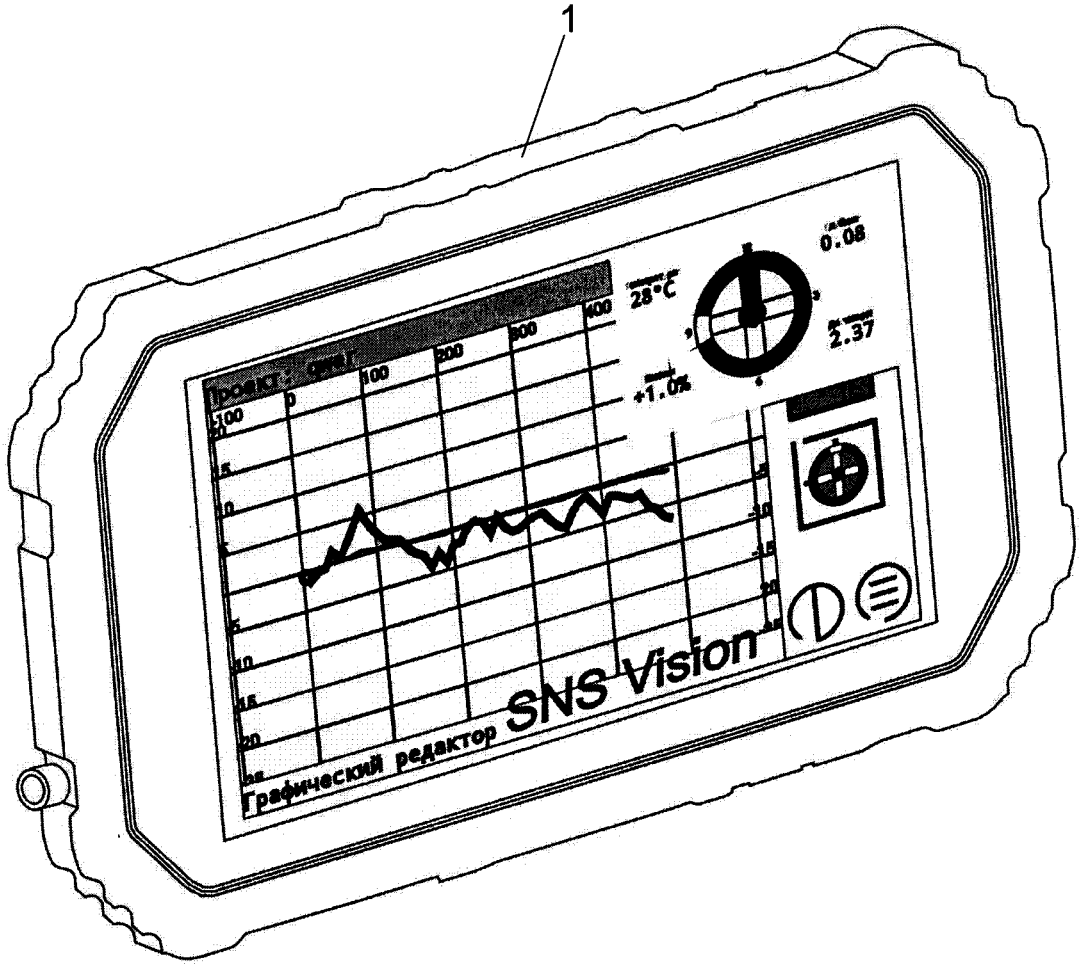
FIG. 5 shows a computer with the SNS A100 program installed (developer by SENSE HDD LLC).

The borehole bottom profile control system at the reaming stages during the construction of communications using the horizontal directional drilling method contains a computer 1 (FIG. 1, 5), software installed on it for processing and building a borehole bottom profile, for example, the SNS A100 program (developer by SENSE HDD LLC) or similar software that provides the possibility of processing the data received from the device for monitoring the angles of the bottom of the borehole 2 (FIG. 1) and processing them. The computer 1 is configured to be connected to the device for monitoring the angles of the bottom of the borehole 2, while the device for monitoring the angles of the bottom of the borehole 2 consists of a housing 3 (FIG. 2), made, for example, in the form of a pipe having a front 4 (FIG. 2) and a rear 5 (FIG. 3) plugs. Inside the housing 3 is installed autonomous power source 6 (FIG. 1, 3), such as batteries. Accelerometers 7 and 8 are installed in housing 3 (FIG. 1), connected to the electronic board and processor 9 by a device for recording and storing information 10. To provide power to the electronic board with processor 9, an autonomous power source 6 is connected. Device for monitoring the angles of the bottom of the borehole 2 can be connected to computer 1 by cable 11 for reading information and charging batteries during work in the process of reaming the borehole, while cable 9 is inside the drill string. The cable 11 is connected to the device for monitoring the angles of the bottom of the well 2 through the connector 12 (FIG. 1, 2).

The claimed invention works as follows.

During any reaming stage, the drill string rotates. During rotation, accelerometers 7 and 8 transmit information about the beginning of rotation to the processor 9. During rotation, the processor 9 goes into sleep mode to conserve battery power. After the rotation is stopped for the period of work on adding next rod to the drill string, the accelerometers 7 and 8 transmit information to the processor 9 about the absence of a change in the angle and simultaneously transmit the current angle readings to it. Next, processor 9 receives information and determines from which accelerometer 7 or 8 this information was received, for example, if the angle is from 0 to 30 degrees, then processor 9 extracts data on the angle from accelerometer 7, if the angle is greater than 30 degrees—from accelerometer 8. The information about the angle of the processor 9 writes to the device for recording and storing information 10. After the start of rotation of the drill string, the process is repeated. And so on until the device is turned off (the end of the production process of current stage). The presence of two accelerometers is due to the fact that one is more accurate at angles from 0 to 30 degrees, the other—from 30 to 90 degrees. After removing the bottom angle control device 2 from the well, plug 5 is unscrewed and cable 11 is connected to connector 12 for interfacing with computer 1. The data transfers and records on computer 1. Next, the operator additionally enters information about the length of the rod into the program. The data is processed by software, for example, the SNS A100 program (developed by SENSE HDD LLC) or similar software that provides the ability to process the data received from the angle control device and process them, after which the data is displayed in the form of a table for analysis and a decision on further actions for the production of works. The table consists of three columns: rod/measurement number, rod length and angle. Using the table data, the operator builds a profile of the bottom of the borehole using the program. Having the actual profile of the bottom of the borehole, a table with angles and other parameters, such as the characteristics of the pipe (information about the maximum bending of the pipe and the buoyancy of the pipe), the operator decides on further actions. For example, in the presence of critical angles, the worker decides on the need for additional reaming of the well, drilling it with a different type of reamer and/or measures to ballast the pipe during pulling. Similarly, all work can be carried out with a permanently connected computer 1 to the device for monitoring the angles of the bottom of the borehole 2 through the cable 11, which in this case passes through the drill string, which allows you to control the angles of the borehole in real time.

The invention claimed is:

1. A system for monitoring angles of a profile of a bottom of a borehole at stages of reaming during construction of communications using a method of horizontal directional drilling, the system comprising:

a computer with installed software for processing and building a profile of the bottom of the borehole after each reaming and configured to connect a device for monitoring angles of the bottom of the borehole to the computer, the device for monitoring the angles of the bottom of the borehole comprising a housing, the device for monitoring being spaced apart from and in the borehole behind a reamer during reaming;

the housing comprising accelerometers, an electronic board with a processor, a device for recording and storing information of the angles of the profile of the bottom of the borehole obtained during each stage of reaming, and a power source.

2. The system according to claim 1, wherein the device for monitoring the angles of the bottom of the borehole is connected to the computer via a cable.

* * * * *